United States Patent [19]

Schleich et al.

[11] Patent Number: 4,779,395

[45] Date of Patent: Oct. 25, 1988

[54] COMPOSITE CONCRETE/STEEL FIREPROOF COLUMN

[75] Inventors: Jean-Baptiste Schleich, Kockelscheuer, Luxembourg; Raymond Baus, Liege, Belgium

[73] Assignee: Arbed S.A., Luxembourg, Luxembourg

[21] Appl. No.: 901,782

[22] Filed: Aug. 28, 1986

[30] Foreign Application Priority Data

Aug. 30, 1985 [LU] Luxembourg ..... 86063

[51] Int. Cl.[4] ..... E04C 3/34

[52] U.S. Cl. ..... 52/724; 52/723; 52/725; 52/727

[58] Field of Search ..... 52/724, 725, 722, 723, 52/726, 309.16, 727, 720, 729, 732

[56] References Cited

U.S. PATENT DOCUMENTS

| | | | |
|---|---|---|---|
| 312,349 | 2/1885 | Griffin | 52/725 |
| 515,963 | 3/1894 | Krause | 52/727 |
| 596,217 | 12/1897 | Rapp | 52/725 |
| 650,299 | 5/1900 | Broussas | 52/722 |
| 916,378 | 3/1909 | Sunderland | 52/722 |
| 925,865 | 6/1909 | Brown | 52/724 |
| 926,005 | 6/1909 | Kerlin et al. | 52/724 |
| 966,274 | 8/1910 | Vainwright et al. | 52/722 |
| 1,203,283 | 10/1916 | Utzman | 52/724 |
| 1,457,598 | 6/1923 | Osborne | 52/727 |
| 1,573,735 | 2/1926 | Nelson | 52/722 |
| 2,065,493 | 12/1936 | Grenlich | 52/723 |
| 2,198,985 | 4/1940 | Bailey | 52/725 |
| 4,261,156 | 4/1981 | Fromont et al. | 52/724 |
| 4,571,913 | 2/1986 | Schleich et al. | 52/727 |

FOREIGN PATENT DOCUMENTS

| | | | |
|---|---|---|---|
| 813020 | 7/1951 | Fed. Rep. of Germany | 52/725 |
| 2743639 | 3/1978 | Fed. Rep. of Germany | 52/725 |
| 211069 | 8/1940 | Switzerland | 52/722 |
| 485924 | 3/1970 | Switzerland | 52/725 |
| 237221 | 11/1925 | United Kingdom | 52/722 |
| 8648 | 12/1987 | United Kingdom | 52/725 |

*Primary Examiner*—Carl D. Friedman
*Assistant Examiner*—Michael Safavi
*Attorney, Agent, or Firm*—Herbert Dubno; Andrew Wilford

[57] ABSTRACT

A fireproof construction element has a plurality of integrally interconnected and parallel profile beams each having a longitudinally extending outer flange defining an outer surface and a longitudinally extending web extending inwardly from the flange. The webs are each formed adjacent the flange with a row of at least generally longitudinally extending, elongated, and laterally throughgoing slots. The beams form a plurality of outwardly open channels laterally bounded by the flanges. Respective masses of concrete substantially fill the channels between the webs and inward of the flanges and have outer surfaces contiguous with the outer surfaces of the beam flanges. The slots can be provided in two rows with the slots of one row overlapping and staggered with the rows of the other row.

20 Claims, 3 Drawing Sheets

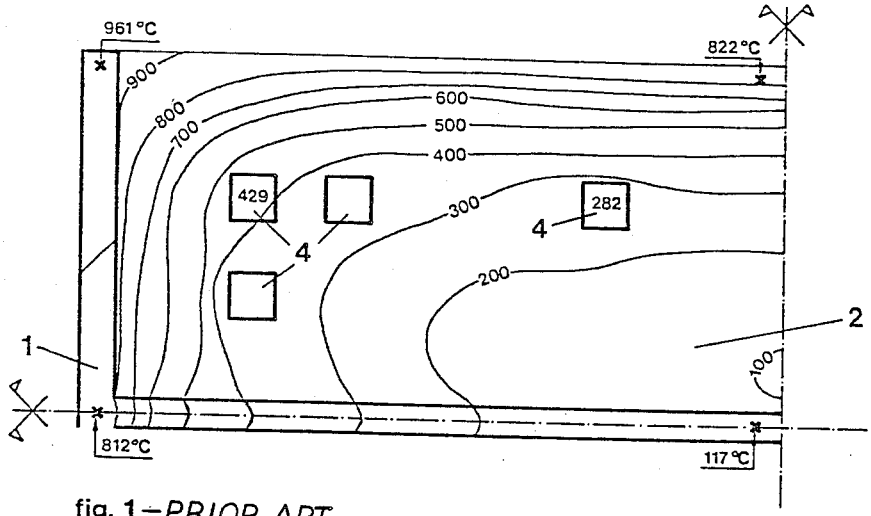
fig. 1—PRIOR ART
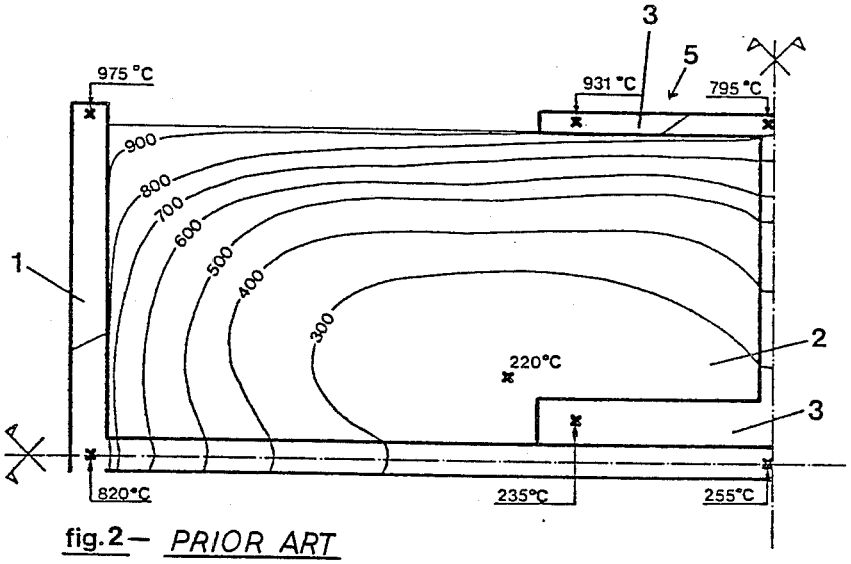
fig. 2— PRIOR ART

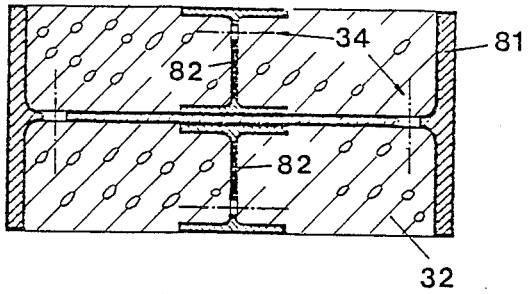
fig. 8
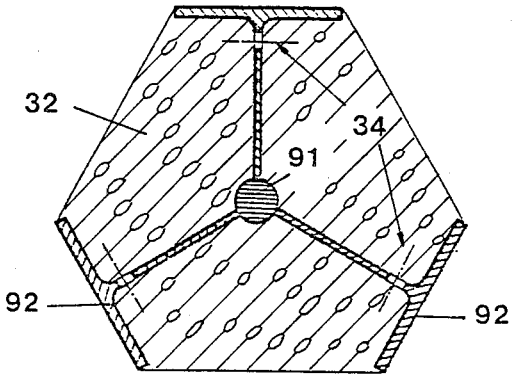
fig. 9
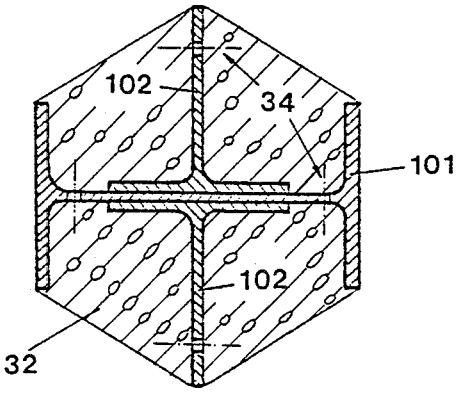
fig. 10
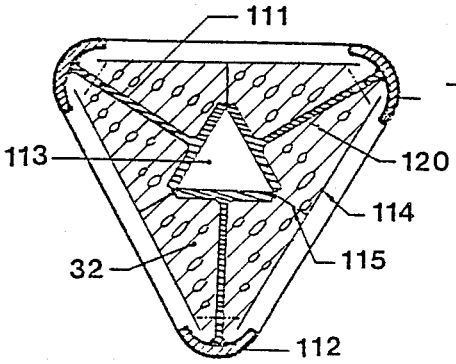
fig. 11
fig. 12
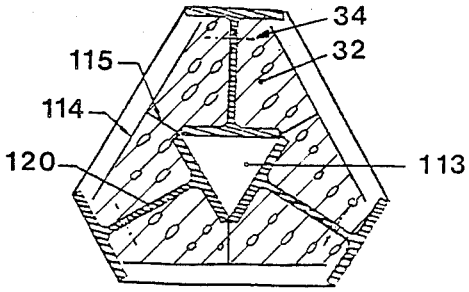

COMPOSITE CONCRETE/STEEL FIREPROOF COLUMN

FIELD OF THE INVENTION

The present invention relates to a composite concrete/steel structural element. More particularly this invention concerns a concrete/steel beam unsable as a column and having exposed steel beam surfaces.

BACKGROUND OF THE INVENTION

It is standard to rate the static load that can be carried by a steel beam at ambient temperature, and to fireproof it in the field by spraying or otherwise cladding the installed steel with concrete. Such covering with concrete before installation is ruled out since it is essential to be able to bolt together faces of the steel of the beam for dimensional as well as structural accuracy. Precoating with concrete would make the structural elements impossible to dimension accurately, since the sprayed coating cannot be made as accurately as the steel beam itself unless done in a mold.

In recent times it has been suggested to make a fireproof structural element by filling a longitudinal channel of the beam in question with concrete and even stabilizing this concrete with reinforcing bars. Thus, as described in German patent document No. 2,829,864, the channels of an I- or H-beam are completely filled with concrete, flush with the edges of the flanges, and while leaving the outer faces of these flanges fully exposed. In order to prevent differential thermal expansion from separating the concrete from the beam in a fire, it is standard to provide connectors welded to the beam web so that the concrete and beam are solidly locked together. This concrete, in which steel reinforcing bars are imbedded, does not project beyond the planes defined by the outer edges of the flanges, so the outline, that is the outer dimensions of the thus fireproofed beam, remains that of the basic I- or H-beam, greatly easing subsequent installation.

In a fire the exposed beam flanges are heated first, so that, although under normal circumstances they bear most of the load, they weaken and the load is transferred to the reinforced-concrete portion of the composite element. In addition in a fire the steel reinforcement of the concrete is normally positioned so that it also is heated and softens rather rapidly. Thus it is necessary to make the composite beam relatively massive and correspondingly expensive to obtain the desried fire rating.

Another disadvantage of the known such composite beam is that its fabrication is fairly complex, requires excessive effort in the field. Thus the heavy beams must be transported to the job from a remote shop.

Accordingly in commonly owned U.S. Pat. No. 4,571,913 a composite structural element is described having a main steel beam having a web and at least two flanges extending therefrom, having oppositely directed outer faces, having outer edges generally defining a plane and defining with the web a recess open away from the web between the outer edges. A mass of concrete fills the recess substantially to the plane, the outer flange faces being exposed and substantially free of concrete. Another profiled steel beam is fixed to the web of the main beam and is wholly imbedded in and covered by the concrete mass. Typically according to this earlier invention the main beam is an H- or I-beam and has two such channels provided with such other beams and filled with respective such masses.

Such an arrangement takes longer to weaken in a fire, but is still susceptible of improvement. This is particularly a problem with columns of regular polygonal section which are most attractive and convenient to use when all of their critical outer surfaces are formed of the flat flanges of the steel profile elements imbedded in the concrete.

OBJECTS OF THE INVENTION

It is therefore an object of the present invention to provide an improved composite steel/concrete structural element.

Another object is the provision of such a composite steel/concrete structural element which overcomes the above-given disadvantages, that is which retains more of its strength longer in a fire than a prior-art structure.

A further object is to provide such a structural element or composite beam which can have all its critical corners are metal clad, that is formed by the flanges of the imbedded steel but which nonetheless is stronger in a fire than even a standard unclad such element.

SUMMARY OF THE INVENTION

A fireproof construction element according to the invention has a plurality of integrally interconnected and parallel profile beams each having a longitudinally extending outer flange defining an outer surface and a longitudinally extending web extending inwardly from the respective flange. The webs are each formed adjacent the flange with a row of at least generally longitudinally extending, elongated, and laterally throughgoing slots. The beams form a plurality of outwardly open channels laterally bounded by the flanges. Respective masses of concrete substantially fill the channels between the webs and inward of the flanges and have outer surfaces contiguous with the outer surfaces of the beam flanges.

With this structure very little cold strength, that is the overall resistance to bending and so on at ambient temperature, is lost to the slots, but the transmission of heat from the flanges to the core of the beam is greatly hindered, much as how a meander seal hinders flow by constantly diverting it in a hydraulic system. Such a beam has substantially greater strength in a fire after a given time than even a so-called unclad beam, that is one where an entire profile element is imbedded in the concrete mass.

According to this invention the slots are of uniform width and have rounded ends. They can also be relatively narrow and have relatively wide generally circular ends. The slots can extend substantially parallel to the flanges or at an acute angle to the flanges. Either way the webs can be formed with two such rows of slots offset laterally relative to each other and with the slots of one row staggered relative to and overlapping the other row. This greatly elongates the path heat must be conducted along to get from the flanges to the center of the composite beam.

In accordance with a further feature of this invention a material of lower thermal conductivity than concrete fills the slots. In addition an elongated reinforcement can be secured to the webs inward of the slots, that is to the side thereof opposite the respective flanges, in order to compensate for any minor loss in strength due to the slots. This reinforcement is elongated steel.

DESCRIPTION OF THE DRAWING

The above and other features and advantages will become more readily apparent from the following, it being understood that any feature described with reference to one embodiment of the invention can be used where possible with any other embodiment. In the accompanying drawing:

FIGS. 1 and 2 are cross sections through portions of prior-art beams, respectively without and with external metal cladding and showing the isotherms when the beam is heated;

FIGS. 7, 8, 9, 10, 11, and 12 are cross sections through second, third, fourth, fifth, sixth, and seventh embodiments of the invention.

SPECIFIC DESCRIPTION

Figure 3:
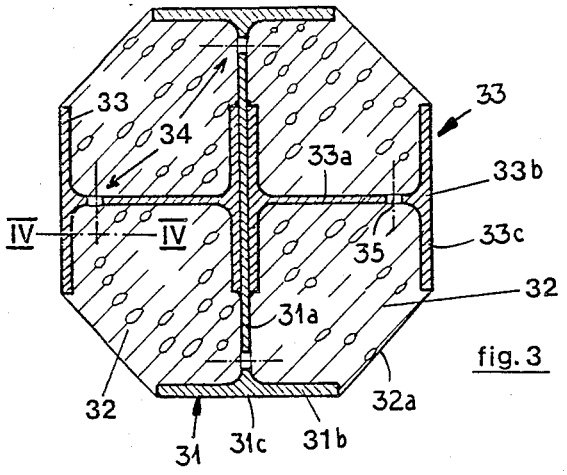
FIG. 3 is a cross section through a first embodiment of the beam of this invention.

As seen in FIGS. 1 and 2 two H-beams 1, of which here quarters are shown with the webs horizontal and flanges vertical, are filled with a concrete mass 2 for fire protection. These beams 1 are of type HE 650 AA. The concrete mass 2 of the beam of FIG. 1 is provided with imbedded reinforcement as indicated schematically at boxes 4. The beam 1 of FIG. 2 is provided with a central I-beam 3 welded to the center of its flange and having its upper flange exposed at the outer surface of the composite beam. This second beam 3 makes handling the beam much easier, makes it much stronger when closed, and makes the beam substantially more attractive for use, for instance, as a column.

A comparison of the isotherms of FIGS. 1 and 2 indicates that after being exposed to fire for an hour the standard beam of FIG. 1 has a hottest point at 961° C. and a central coolest point at 100° C. seen respectively at the upper left and lower right in the drawing. On the other hand the beam of FIG. 2 has a hotter point that is negligeably warmer at 975° C., but a coolest point that is a startlingly high 220° C. In addition the temperatures near the very centers of the beams, in the lower right-hand corners of the respective figures, is only 117° C. in the beam of FIG. 1, but more than twice as high, namely 255° C. Thus at this very critical point in the structure the temperature is so very high that the strength of the beam is seriously reduced. It is therefore apparent that the extra beam 3 of FIG. 2, while conferring considerably greater strength when cold, actually makes the structural element weaker in a fire.

FIG. 3 shows the composite beam according to the present invention which is formed of a central I-beam having a long web 31*a* and two flanges 31*b* and a pair shorter H-beams having short webs 33*a* about half as long as the web 31*a*, and flanges 33*b* about identical to the flanges 31*b*. One flange 33*b* of each short H-beam 33 is welded to each side of the center of the web 31*a* of the center beam 31 so that the outer surfaces 31*c* and 33*c* of the outer webs 31*b* and 33*b* define with the outer surfaces 32*a* of masses of concrete 32 filling between the beams an equilateral octagon, that is an eight-sided figure.

Figure 4:
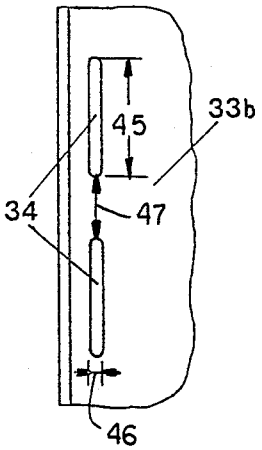
FIG. 4 is a longitudinal section taken through a detail of FIG. 3 along line IV—IV.
Figure 5:
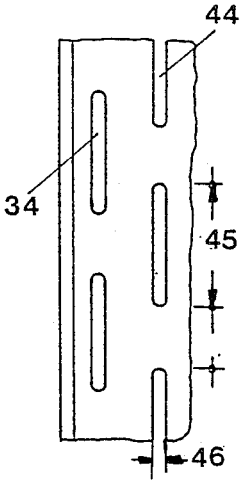
FIGS. 5 and 6 are views like FIG. 4 but showing variants on the embodiment of FIG. 3.

In accordance with this invention the webs 31*a* and 33*a* are formed with identical longitudinally extending and transversely throughgoing slots 34 immediately adjacent their outer flanges 31*b* and 33*b* having the outer surfaces 31*c* and 33*c*. These slots 34 as seen in FIG. 4 extend in longitudinal alignment and each have a length 45 of about 20 cm which is about twice the space 47 between them and about ten times the 2cm width 46 of the slots 34. It is also possible as seen in FIG. 5 to use two such rows of slots 34 and 44, with the slots of one row staggered longitudinally relative to those of the other row. The slots 34 and 44 are cut out of the webs 31a and 33a with a torch and increase the time it takes for the core of the beam to get hot by a factor of 1.5 for the single row of FIG. 4 and a factor of 2.0 for the double row of FIG. 5. In addition as indicated in FIG. 3 the slots 35 may be filled with a material 35 of substantially less conductivity than concrete, namely air, (expanded polystyrene), or polyvinyl chloride. When solid plugs of the material 35 are used they make it easier to fill the channels formed by the beams 31 and 33 with concrete.

Figure 6:
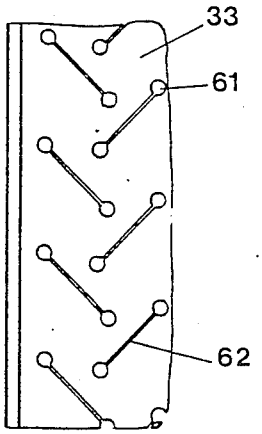

An effect similar to that of FIG. 5 can be achieved as seen in FIG. 6 by cutting a plurality of herringbone but not intersecting slots 62 that terminate at 2 cm diameter holes 61. These slots 62 are cut with a torch after the holes 61 are bored, so that they are only a few millimeters wide. The ends of the slots overlap longitudinally so that, like in FIG. 1, the path for thermal conduction along the web 33*b* is not straight. This creates a meander effect for the heat flow.

Figure 7:
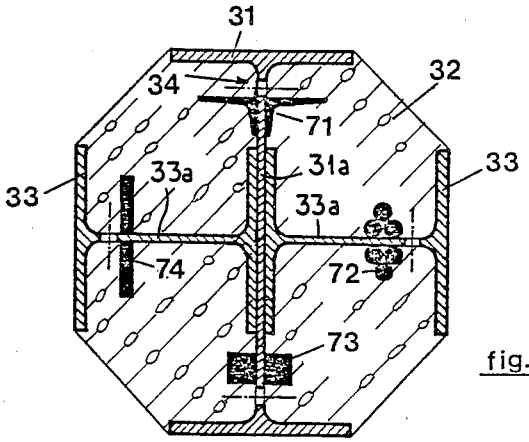

In order to compensate for any weakening of the beam by cutting such slots in it, as such a beam will be weaker under normal conditions even though in a fire it will retain this strength long after an unslotted beam would have grown weaker than it, it is possible as shown in FIG. 7 to fix angle irons 71 to the web 31*a* adjacent the slots 34, or clusters of round reinforcing bars 72 to the web 33*a*. Square-section reinforcing rods 73 can also be secured to the web 31*a* and plates 74 can be secured edgewise to the web 33*a*. When the angle irons 71 of FIG. 7 are combined with the system of FIG. 6 it is possible to secure the angle irons 71 in place via bolts extending through the innermost holes 61. Any combination of this style of reinforcement can overcome any minor strength loss from the webs 31*a* and/or 33*a*, since it is axiomatic that the webs themselves in this type of structure are less important as far as strength than the flanges. These structures 71 through 74 keep the elements at the core of the beam quite cool as they act to divert to concrete the heat flow entering the beam's outer surfaces.

The beam of FIG. 8 is of rectangular section, twice as wide as it is high. It is formed of a single wide but short H-beam 81 and two shorter I-beams 82. The slots 34 are formed, as in FIGS. 3 through 5, in the webs of these beams 81 and 82. Such a beam is about 50% more resistant to fire than the same structure without the slots.

In FIG. 9 a composite beam element has three T-beams 92 having central legs joined to a core rod 91 with the beams 92 extending at 120° to one another. The slots 34 here increase the fire resistance, but this structure needs further web reinforcement inward of the slots 34 as shown in FIG. 7 for heavy-duty applications.

The hexagonal-section structure of FIG. 10 has a central wide-web H-beam 101 and a pair of large T-beams 102 with their flanges welded to the web of the beam 101. The slots 34 in the legs of the T-beams 102 are not strictly essential as the limited exposed edge surfaces of these structures are not sufficiently large to pick up significant heat.

In FIG. 11 a round-corner triangular-section composite beam is shown having three I-beams 111, each with one inwardly rounded flange and each formed by welding a third-cylindrical tube to the leg of a T-beam. The space 113 formed between the inner flanges can be left empty for use as a utility chase or can be filled with concrete or even water. A wire reinforcement mesh 114 can be secured by ties 115 to the beams 111 and serves to stabilize the masses 32 of concrete filling the channels formed by the beams 111.

FIG. 12 shows an arrangement like that of FIG. 11 except that standard flat-flange I-beams 120 are used instead of the round-flange structures 111 of FIG. 11. The result is a six-sided cross section.

We claim:

1. A composite fireproof steel/concrete column comprising:

a steel structural element formed with at least three beams having webs which angularly adjoin one another and are secured together and at least two flanges on at least one of said webs perpendicular to the respective web and defining respective outer surfaces of said column;

a mass of concrete filled into regions defined between said webs and defining outer surfaces of said column between outer edges of said beams so that said mass lies within planes defined by said outer edges of said beams and leaves said outer surfaces of said flanges fully exposed, said outer edges of all of said beams extending to outer surfaces of the column and the mass; and heat-conductivity-limiting means for limiting heat conductivity of and thermal deterioration of said beams, said heat-conductivity-limiting means including at least one pair of rows of elongated slots formed in each web near an outer portion of said web and staggered longitudinally from one row to the other of each pair so that transversely, said slots of each pair overlap each other, said slots being filled with a material with a heat conductivity less than that of said steel structural element.

2. The steel/concrete structural column defined in claim 1 wherein each of said beams has at least one flange and inner parts of said beams are welded together to define an inner space of the column.

3. The steel/concrete structural column defined in claim 1, further comprising a core rod, each of said webs being welded to said rod.

4. The steel/concrete structural column defined in claim 1 wherein said one of said beams is a first I-beam having two flanges forming outer surfaces of said column and a web of the first I-beam bridging said two flanges, and each other beam is a further I-beam having an inner flange connected to a web of the further I-beam and welded to the web of the first I-beam, said first I-beam being about two times as wide as each of said further I-beams.

5. The steel/concrete structural column defined in claim 1 wherein said one of said beams is a first I-beam having two flanges forming outer surfaces of said column and a web of the first I-beam bridging said two flanges of said I-beam, and each other beam is a further I-beam having an inner flange connected to a web of the further I-beam and welded to the web of the first I-beam, and said first I-beam is about four times as wide as each of said further I-beams.

6. The steel/concrete structural element defined in claim 1 wherein said one of said beams is an I-beam and each of the other beams is a T-beam having a flange welded to the web of said I-beam.

7. The steel/concrete structural element defined in claim 1, further comprising reinforcing means affixed on at least one of said webs adjacent the respective slots for compensating for structural weakening of the respective beam by said slots.

8. The steel/concrete structural element defined in claim 7 wherein said reinforcing means consists of angle irons.

9. The steel/concrete structural element defined in claim 7 wherein said reinforcing means comprises clusters of reinforcing bars.

10. The steel/concrete structural element defined in claim 7 wherein said reinforcing means comprises square-section bars.

11. A composite fireproof steel/concrete column comprising:

a steel structural element formed with at least three beams having webs which angularly adjoin one another and are secured together and at least two flanges on at least one of said webs perpendicular to the respective web and defining respective outer surfaces of said column;

a mass of concrete filled into regions defined between said webs and defining outer surfaces of said column between outer edges of said beams so that said mass lies within planes defined by said outer edges of said beams and leaves said outer surfaces of said flanges fully exposed said outer edges of all of said beams extending to outer surfaces of the column and the mass; and heat-conductivity-limiting means for limiting heat conductivity of and thermal deterioration of said beams, said heat-conductivity-limiting means including at least one pair of rows of elongated slots formed in each web near an outer portion of said web and staggered longitudinally from one row to the other of each pair so that transversely, said slots of each pair overlap each other, said slots being filled with a material with a heat conductivity less than that of said concrete, the slots of one row of each pair being inclined in a directed away from the slots of the other row of the respective pair.

12. A composite fireproof steel/concrete column comprising:

a steel structural element formed with at least three beams having webs which angularly adjoin one another and are secured together, at least one of said beams having at least two flanges perpendicular to the respective web and defining respective outer surfaces of said column;

a mass of concrete filled into regions defined between said webs and defining other outer surfaces of said column between outer edges of said beams so that said mass lies within planes defined by said outer edges of said beams and leaves said outer surfaces of said flanges fully exposed, said outer edges of all of said beams extending to outer surfaces of the column and the mass; and heat-conductivity-limiting means for limiting heat conductivity of and deterioration of said beams, said heat-conductivity-limiting means including at least one row of elongated slots in each said web near an outer portion of said web extending at least generally in a longitudinal direction of each beam, the distance between the slots of said at least one row of elongated slots being substantially less than the lengths of said slots, said slots being filled with a material with a lower heat conductivity than that of steel structural element.

13. The steel/concrete structural column defined in claim 12 wherein each of said beams has at least one flange and inner parts of said beams are welded together to define an inner space of the column.

14. The steel/concrete structural column defined in claim 12, further comprising a core rod, each of said webs being welded to said rod.

15. The steel/concrete structural column defined in claim 12 wherein said one of said beams is a first I-beam having two flanges forming outer surfaces of said column and a web of the first I-beam bridging said two flanges, and each other of said beams is a further I-beam having an inner flange connected to a web of the further I-beam and welded to the web of the first I-beam, said first I-beam being about twice as wide as each of said further I-beams.

16. The steel/concrete structural column as defined in claim 12 wherein said one of said beams is a first I-beam having two flanges forming outer surfaces of said column and a web of the first I-beam bridging said two flanges of said one of said I-beams, and each other beam is a further I-beam having an inner flange connected to a web of the further I-beam and welded to the web of the first I-beam and said first I-beam is about four times as wide as each of said further I-beams.

17. The steel/concrete structural element defined in claim 12 wherein one of said beams is an I-beam and each of the other beams is a T-beam having a flange welded to the web of said I-beam.

18. The steel/concrete structural element defined in claim 12, further comprising reinforcing means affixed on at least one of said webs adjacent the respective row of slots for compensating weakening of the respective beam by said slots.

19. The steel/concrete structural element defined in claim 18 wherein said reinforcing means consists of angle irons.

20. The steel/concrete structural element defined in claim 18 wherein said reinforcing means comprises clusters of reinforcing bars.

* * * * *